US005991936A

United States Patent [19]

Sorimachi

[11] Patent Number: 5,991,936

[45] Date of Patent: Nov. 30, 1999

[54] OPENING AND CLOSING DEVICE OF WESTERN STYLE TOILET SEAT AND SEAT COVER

[75] Inventor: Akira Sorimachi, Kanagawa, Japan

[73] Assignee: Katoh Electrical Machinery Co., Ltd., Kanagawa, Japan

[21] Appl. No.: 09/009,451

[22] Filed: Jan. 20, 1998

[30] Foreign Application Priority Data

Jan. 24, 1997 [JP] Japan ..... 9-011432

[51] Int. Cl.[6] ..... A47K 13/12

[52] U.S. Cl. ..... 4/236; 4/240; 4/248

[58] Field of Search ..... 4/234–237, 240, 4/241, 242.1, 246.1, 246.2, 248; 16/303, 305–308, 50

[56] References Cited

U.S. PATENT DOCUMENTS 5,915,845 6/1999 Lee ..... 4/237

FOREIGN PATENT DOCUMENTS 6-121759 5/1994 Japan ..... 4/248

*Primary Examiner*—Henry J. Recla
*Assistant Examiner*—Tuan Nguyen
*Attorney, Agent, or Firm*—Notaro & Michalos P.C.

[57] ABSTRACT

A Western style toilet seat and seat cover opening-closing device is disclosed, in which a rotating shaft is rotatably mounted in the axial direction of a case body designed to be mounted on the toilet bowl, and a first rotation control of the rotating shaft is provided in a part housed in the case body. In the case body above or below the first rotation control a second rotation control of the rotating shaft are vertically juxtaposed. Between the second rotation controls and the first rotation control mechanism, a driving power transmitting mechanism is disposed. On the rotating shaft, one of the seat or seat cover mounting sections is rotatably mounted through a bearing, while the other is so fixed as to rotate together with the rotating shaft.

3 Claims, 7 Drawing Sheets

OPENING AND CLOSING DEVICE OF WESTERN STYLE TOILET SEAT AND SEAT COVER

BACKGROUND OF THE INVENTION

1. Field of the Invention

The present invention relates to a Western style toilet seat and seat cover opening-closing device suitable for use in controlling the opening and closing operation of particularly the Western style toilet seat and seat cover.

2. Description of the Related Art

As a device for controlling a turning torque of Western style toilet seat and seat cover to prevent abrupt drop of the seat and seat cover at the time of closing and further to stop and hold the seat fast at an intermediate angle of opening particularly for urination, an opening-closing device has been known, in which a rotating shaft rotatably supporting a seat and seat cover mounting section is rotatably mounted within a cylindrical case body attached to the toilet bowl, and is operated through a cam mechanism mounted within the case body and a rotation damper device.

The opening-closing device of the prior art Western style toilet seat and seat cover is long in the axial direction of the rotating shaft, just like a single bar. Therefore, when the case body is supported at one end in a cantilever fashion on a support member fixedly attached on the toilet bowl, the device is likely to become unsteady. In other types of opening-closing devices, as the provision of a large mounting space on the toilet bowl is needed, there exists such a problem that the design of the device will be restricted.

SUMMARY OF THE INVENTION

It is an object of the present invention to provide an opening-closing device for a Western style toilet seat and seat cover which can steadily support the toilet seat and seat cover by a rotating shaft, dispense with a mounting space in a lateral direction on the toilet bowl, and further perform a finer torque control.

To accomplish the above-described object, the present invention is comprised of a rotating shaft rotatably mounted on a case body designed to be mounted on a toilet bowl, a first rotation control means provided on one side housed in the case body of the rotating shaft, second rotation control means juxtaposed in the case body above or below the first rotation control means, and a driving power transmitting means provided between the second rotation control means and the first rotation control means. One of the seat and seat cover mounting sections is rotatably mounted the rotating shaft, while the other is fixedly attached on the rotating shaft so as to rotate together with the rotating shaft.

In the present invention the first rotation control means may be a cam mechanism provided with an elastic means; the second rotation control means may be a torsion spring; and the driving power transmitting means may be a gear or a timing belt.

DESCRIPTION OF THE PREFERRED EMBODIMENTS

Figure 1:
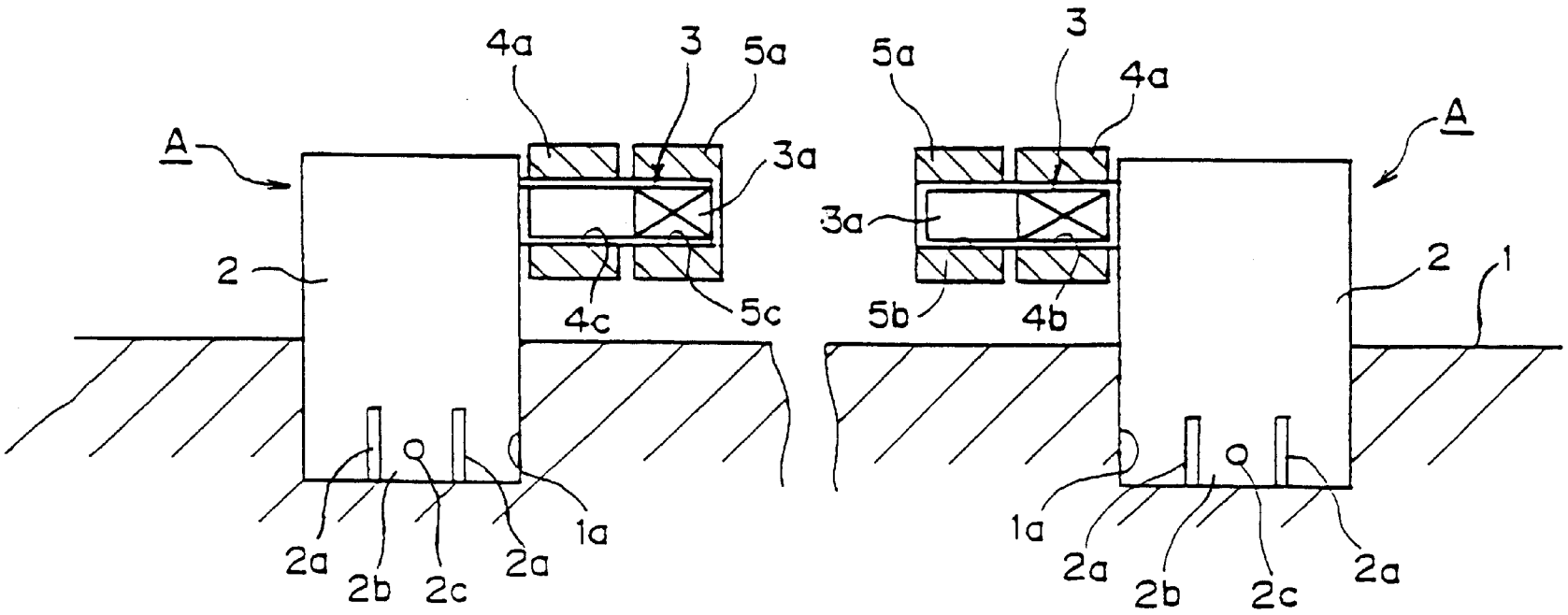
FIG. 1 is an explanatory view explaining the state of an opening-closing device of the present invention mounted on a Western style toilet.
Figure 2:
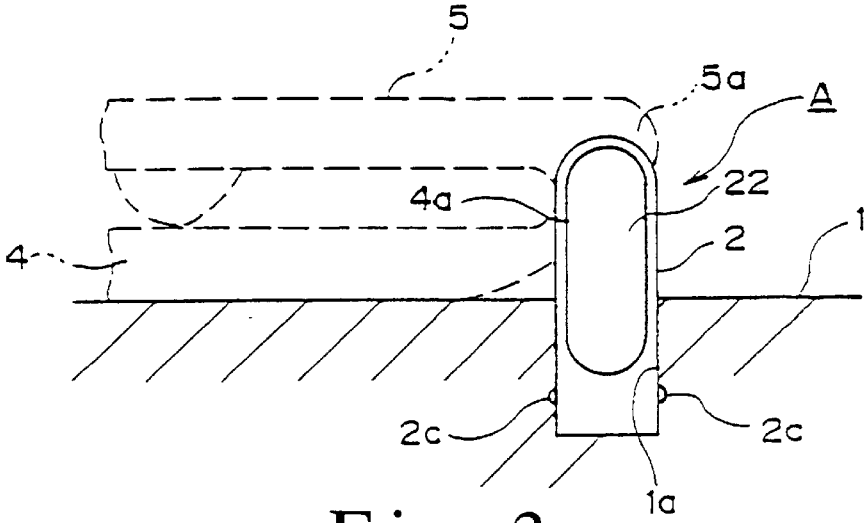
FIG. 2 is similarly an explanatory view explaining the state of the opening-closing device of the present invention mounted on the Western style toilet.
Figure 3:
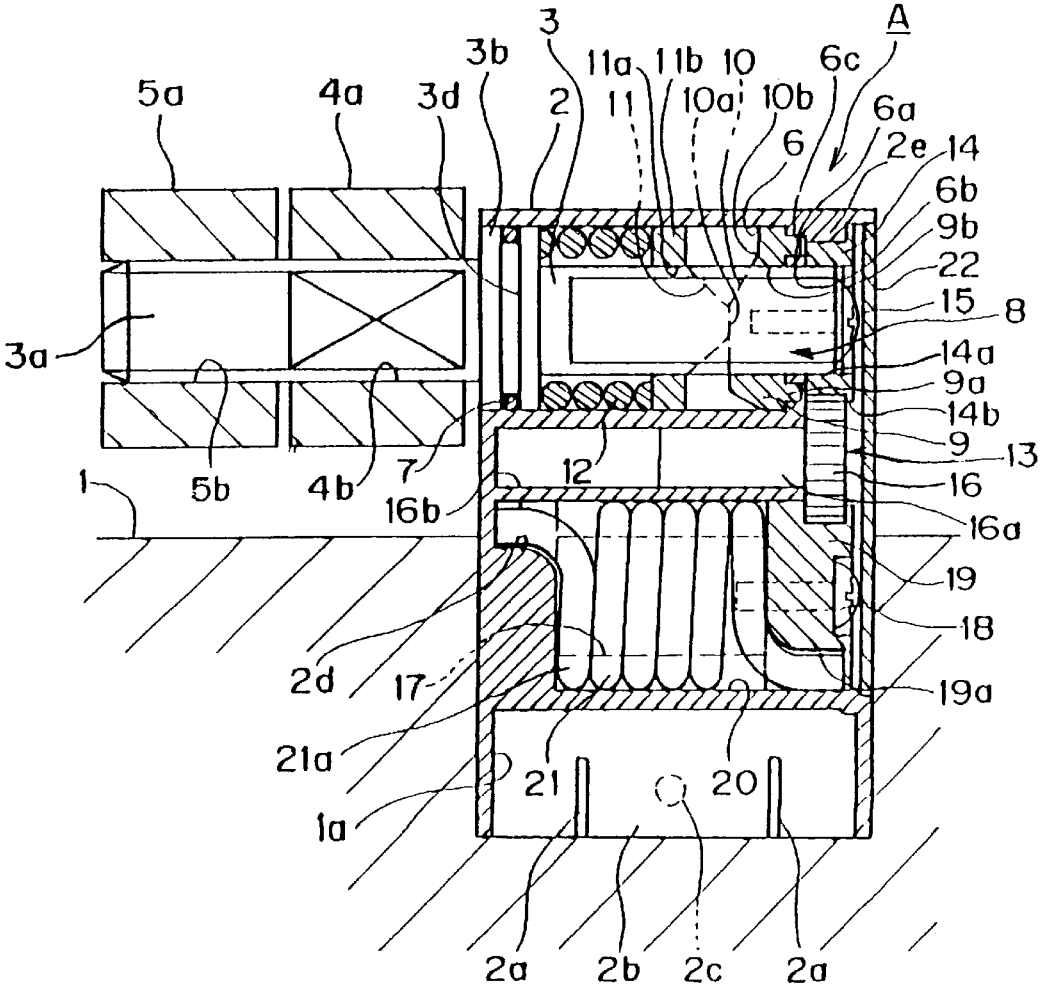
FIG. 3 is a front sectional view showing the internal structure of the opening-closing device of the present invention.
Figure 4:
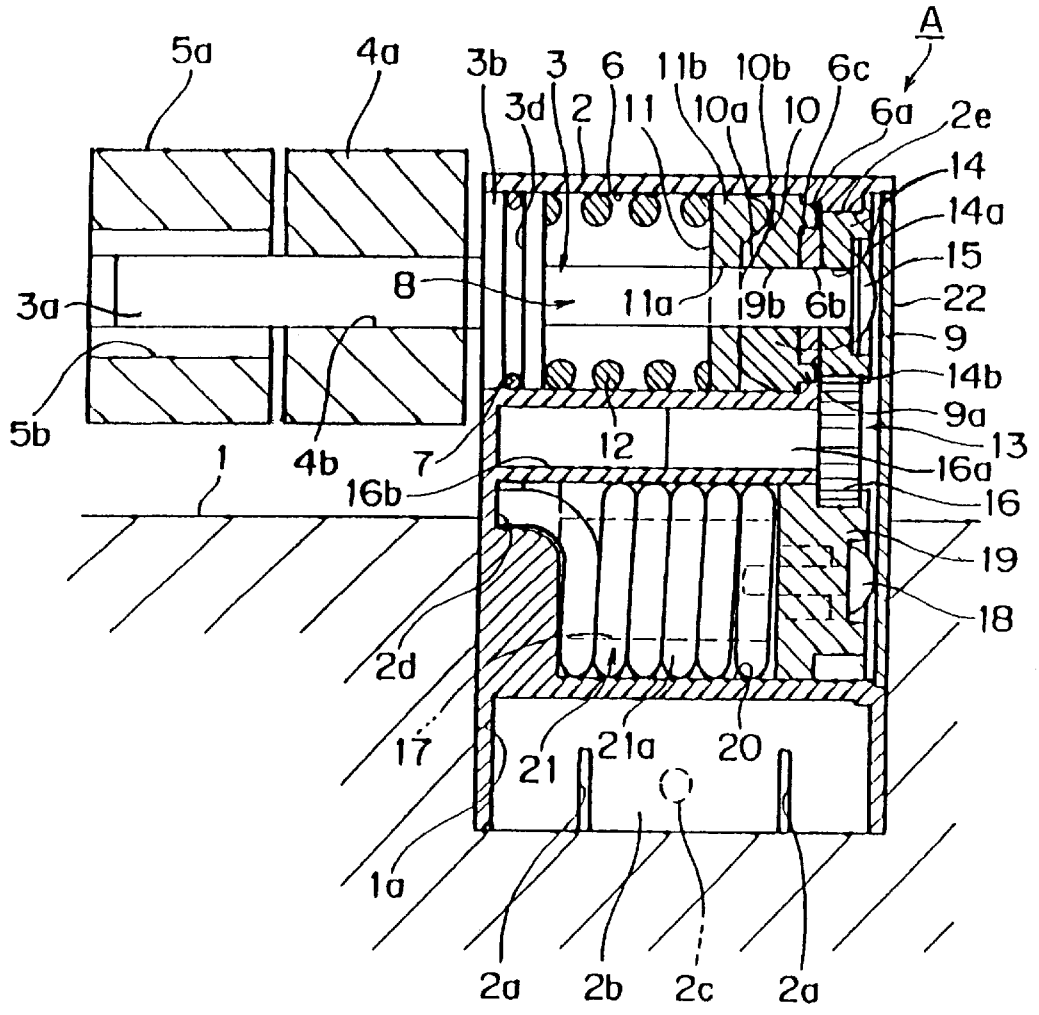
FIG. 4 is a front sectional view explaining the operation of the opening-closing device of the present invention.

The accompanying drawings show one embodiment of the present invention. In FIGS. 1 and 2 right and left mounting holes 1*a*, 1*a* are provided in the upper rear end of a Western style toilet bowl 1. A pair of case bodies 2, 2 are attached with their lower part releasably inserted in the mounting holes 1*a*, 1*a*.

From the mutually opposite upper sides of the case bodies 2, 2, mounting shaft portions 3*a*, 3*a* of the rotating shafts 3, 3 having an approximately elliptical section are protruded. The right one of the rotating shafts 3, 3 is so mounted as to rotate together with the rotating shaft 3 with the mounting shaft portion 3*a* inserted in an irregular mounting hole 4*b* of an approximately elliptical sectional form of another mounting section 4*a* of the seat 4. And furthermore on the mounting shaft portion 3*a* of the rotating shaft 3, one mounting section 5*a* of the seat cover 5 is rotatably supported on a bearing with the mounting shaft portion 3*a* inserted in a shaft insertion hole 5*b* of round sectional form.

The left mounting shaft portion 3*a* the rotating shafts 3, 3 is rotatably mounted with the mounting section 4*a* of the seat 4 inserted in the shaft insertion hole 4*c* of round sectional form provided therein, and another mounting section 5*a* of the seat cover 5 is so mounted as to rotate together with the mounting shaft portion 3*a* of the left rotating shaft 3 inserted and engaged in an irregular mounting hole 5*c*. It is to be noticed that in the opening-closing device shown in the drawing, the rotating shaft 3 and the mounting shaft portion 3*a* are unitarily formed; on the mounting shaft portion 3*a*, one mounting section of the seat 4 and the seat cover 5 is rotatable, while the other mounting section rotates; and that the portion of the mounting member 3*a* may be inserted and fixed, as an independent mounting pin, in a mounting hole provided in the axial direction of the rotating shaft 3.

That is, the pair of opening-closing devices A, A, right and left, of the present invention are mounted on the toilet bowl 1; the right device controls the turning torque of the seat 4, while the left device controls the turning torque of the seat cover 5.

In the portion of the case bodies 2, 2 inserted in the mounting holes 1*a*, 1*a*, a pair of longitudinal grooves 2*a*, 2*a* are provided in a longitudinal direction in the front and rear sides, thereby forming elastic pieces 2*b*, 2*b*. On the elastic pieces 2*b*, 2*b* are provided projections 2*c*, 2*c*, which absorb excess play between the mounting holes 1*a*, 1*a* and the lower side of the case bodies 2, 2 inserted in the mounting holes 1*a*, 1*a*.

FIGS. 3 to 6 show the right opening-closing device A of FIG. 1 described above, which will hereinafter be explained.

The left opening-closing device A also has the same internal structure. The seat and the seat cover differ in weight and operation to be performed, and accordingly torque selection varies due to these differences. Basically, however, these devices are the same in structure notwithstanding their being symmetrical, and therefore the left device will not be explained.

In the drawings, the rotating shaft 3 has a large-diameter portion 3*b* in the inlet portion of the case body 2, and a small-diameter portion 3*c* having an approximately elliptical sectional form provided by cutting both sides consecutively to the large-diameter portion 3*b*. The rotating shaft 3 is rotatably mounted in the case body 2 with the large-diameter portion 3*b* supported on a bearing in the inlet port of a first housing section 6 formed through the case body 2, and with the small-diameter portion 3*c* supported on a bearing in a bearing hole 6*b* formed in a partition wall 6*a* provided in the first housing section 6. A member designated by reference numeral 7 which is fitted in a peripheral groove 3*d* formed in the outer periphery of the large-diameter portion 3*b* is an O-ring for sealing.

In the first housing section 6 is contained a first rotation control means 8 of the rotating shaft 3 which comprises a cam mechanism using a later-described elastic means. The constitution of the first rotation control means 8 is as described below.

First, an engaging projection 9*a* protruding from one side of the stationary cam 9 is fitted in a plurality of engaging holes 6*c* provided in the partition wall 6*a*, to thereby secure the stationary cam 9 from turning. On the other side face of the stationary cam 9, a cam portion 10 comprising a convex portion 10*a* and a concave portion 10*b* is formed, and the small-diameter portion 3*c* is rotatably inserted in the insertion hole 9*b* formed in the center thereof.

A rotating-sliding cam 11 is mounted, oppositely to the cam portion 10 of the stationary cam 9, with the small-diameter portion 3*c* inserted and engaged in the irregular hole 11*a* provided at center, in such a manner that the rotating-sliding cam 11 can rotate together with the rotating shaft 3 and slide in the axial direction. In the position the rotating-sliding cam 11 faces the cam portion 10 of the stationary cam 9, a convex portion 11*b* is provided.

Between the rotating-sliding cam 11 and the large-diameter portion 3*b*, an elastic means 12 consisting of a compression spring wound around the small-diameter portion 3*c* is elastically mounted, to thereby constantly slide to press the rotating-sliding cam 11 in the axial direction towards the stationary cam 9 side. For this elastic means 12, a plate spring is also usable.

On the small-diameter portion 3*c* of the rotating shaft 3 which protrudes out of the partition wall 6*a*, a first gear 14 of a later-described driving power transmitting means 13 is mounted by inserting the protruding portion into an irregular hole 14*a* and is fixedly attached by a mounting screw 15 from loosening off.

In the bearing hole 16*b* provided immediately below the first rotation control means 8 of the case body 2, a shaft portion 16*a* of a second gear 16 of the driving power transmitting means 13 is rotatably support on a bearing. The second gear 16 is in mesh with the first gear 14 and further in mesh with a third gear 19 rotatably supported on a bearing by a locking screw on the forward end of a support shaft 17 which is located below the bearing hole 16*b* and protrusively provided within the case body 2. The driving power transmitting means 13 is composed of the first gear 14, the second gear 16 and the third gear 19. The driving power transmitting means may be for example a timing belt mounted between the first gear 14 and the third gear 19. The rotating member mentioned in this specification includes the first, second and third gears, and pulleys for the timing belt.

Around the support shaft 17, a second housing section 20 of round sectional form is coaxially formed below the first rotation control means 8. In the second housing section 20 a second rotation control means 21 comprising a torsion spring 21*a* is disposed. The torsion spring 21*a* is wound around the support shaft 17, with one end thereof engaged in the engaging hole 2*d* provided in one side of the case body 2, and with the other end thereof engaged in an engaging hole 19*a* provided in the third gear 19 of the driving power transmitting means 13, thereby constantly pressing the third gear 19 to rotate in one direction. The third gear 19 may be pulleys for the timing belt as previously stated.

Figure 5:
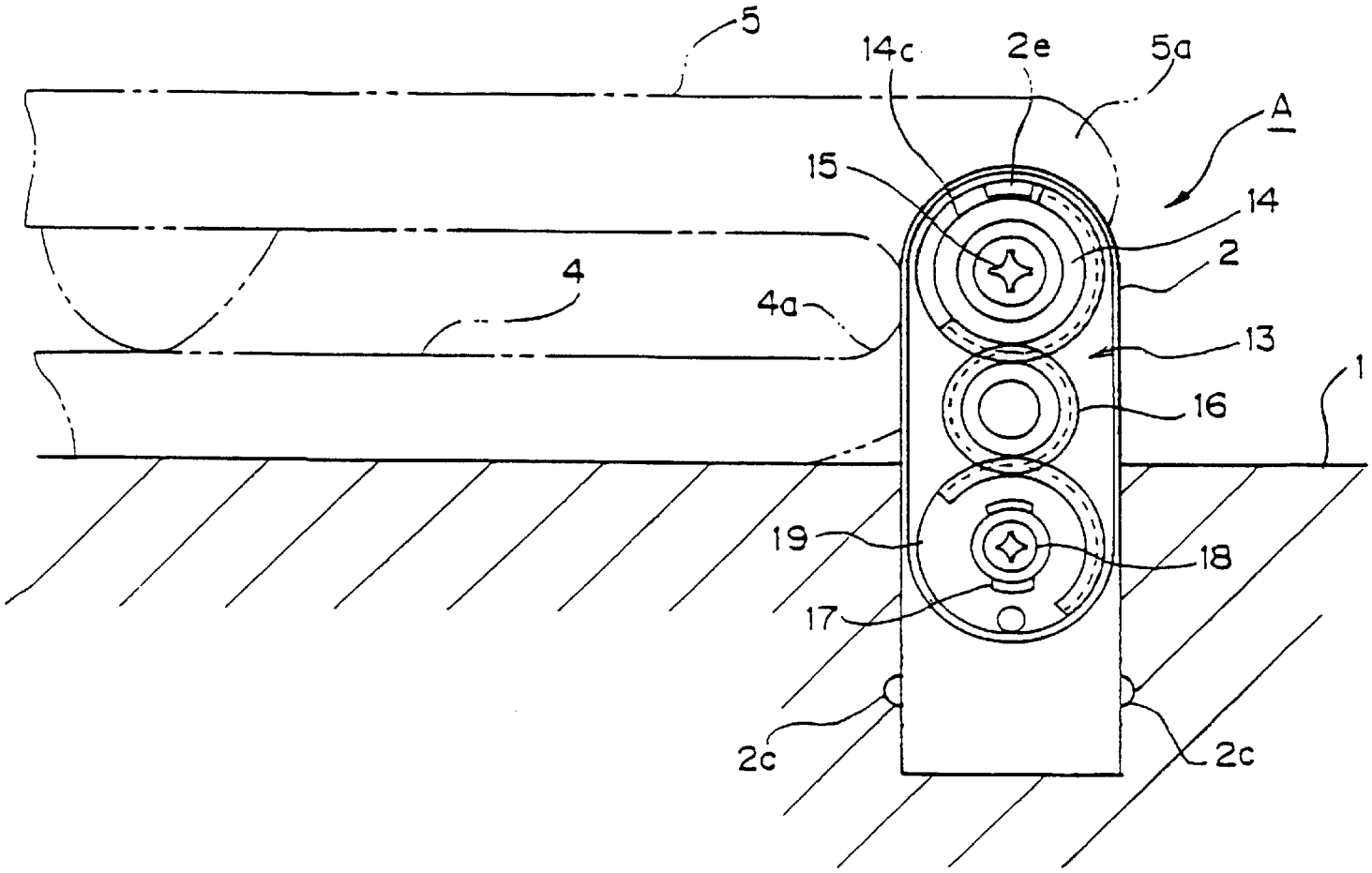
FIG. 5 is a side view, correspondingly to FIG. 3, explaining a driving power transmitting means for the opening-closing device of the present invention.
Figure 6:
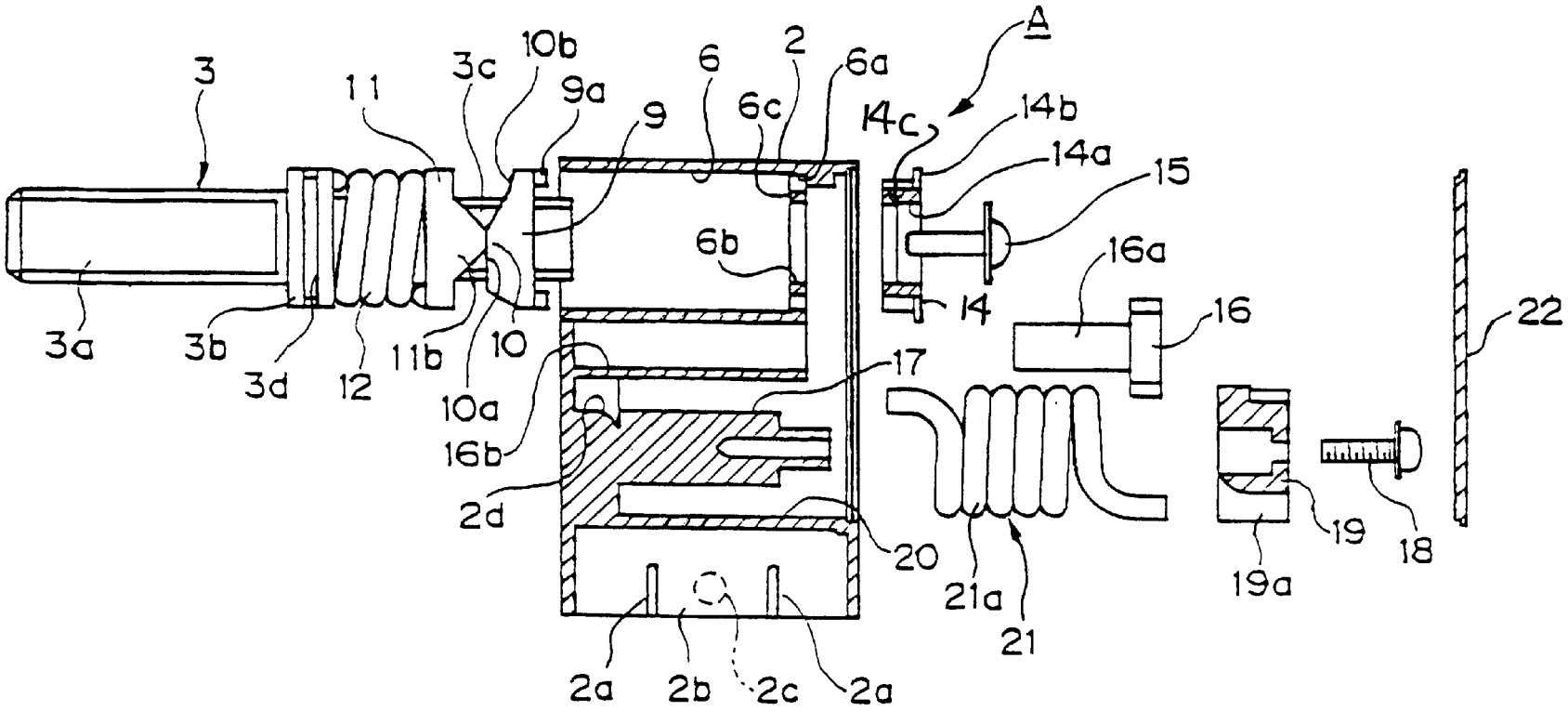
FIG. 6 is an exploded front view of the opening-closing device of the present invention.

The first gear 14 and the third gear 19 of the driving power transmitting means 13 are provided with a toothless portion. The toothless portion of the first gear 14, particularly as shown in FIG. 5, is provided with a half-periphery groove 14*c*; and in the half-periphery 14*c* a stopper 2*e* protruding from the case body 2 is fitted to restrict the rotation of the first gear 14 within a predetermined angle of rotation. The first gear 14 is further provided with a collar 14*b* on the end face, which is engaged with the edge of the second gear 16, thereby preventing outward movement of the second gear 16. Furthermore, in the part of the case body where the driving power transmitting means 13 is mounted, a case cover 22 is fitted to prevent entry of dirt and moisture from outside.

Figure 7:
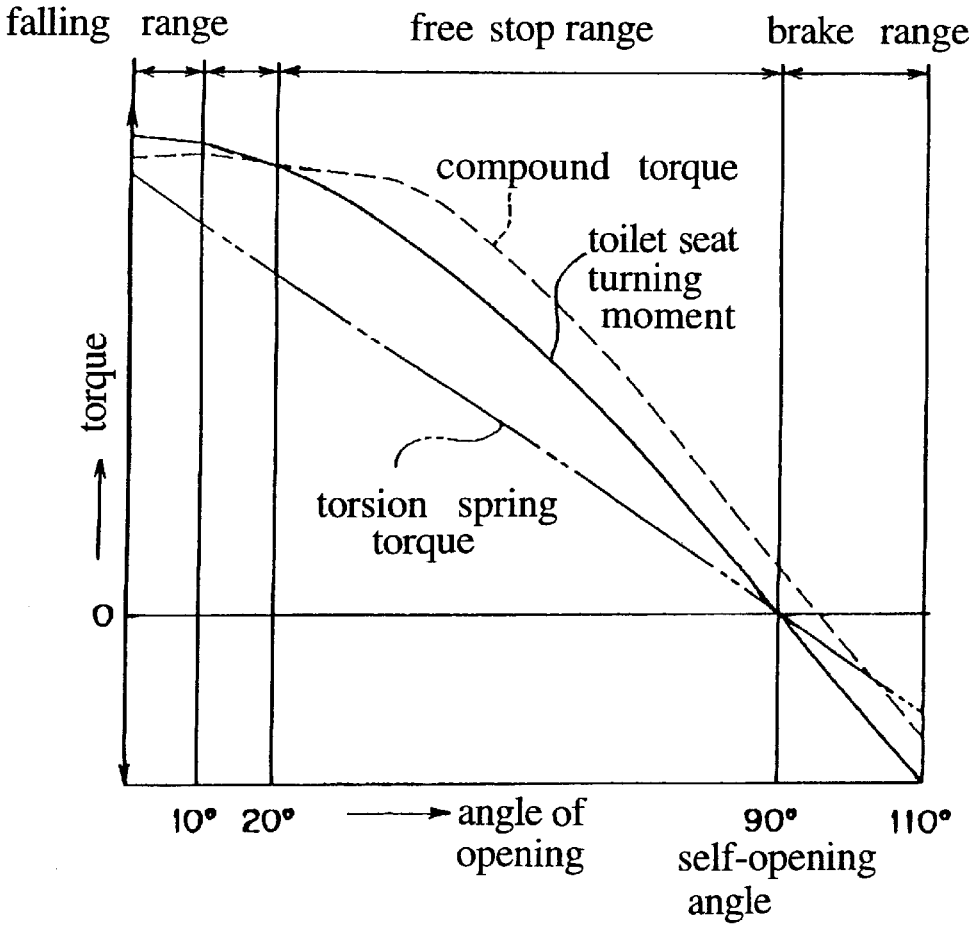
FIG. 7 is a torque curve diagram of the opening-closing device of the present invention.
Figure 8:
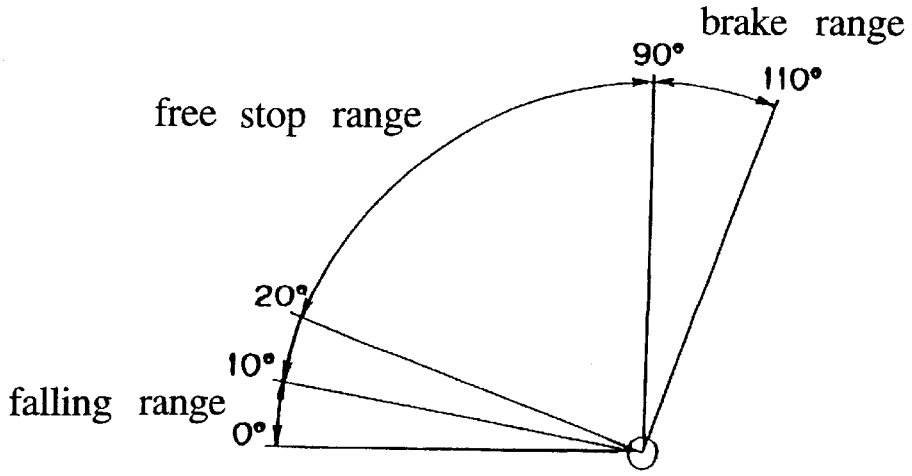
FIG. 8 is an explanatory view explaining the function of the opening-closing device of the present invention.

FIG. 7 is a diagram showing torque curves of the opening-closing device A, in which the torque of the torsion spring of the second rotation control means indicated by a dotted line is always below the turning moment of the seat 4 indicated by a solid line. A combined torque (indicated by a two-dot chain line) inclusive of the torque of the second rotation control means and the torque of the first rotation control means intersects the turning moment at the opening angle of 20 degrees of the seat cover 4 at all times; at an opening angle above 20 degrees, however, the combined torque changes always slightly above the turning moment of the seat 4. Contrarily, at an opening angle below 20 degrees, the combined torque will come below the turning moment of the seat 4. Therefore, as shown in FIG. 8, the seat 4 can freely be stopped and held by the opening-closing device at the opening angle of from 20 degrees to 90 degrees, and can absorb bound and rebound at an opening angle of over 90 degrees. The seat 4, when released at the closing angle of 20 degrees, starts to slowly drop to a position at 10 degrees, from which position the seat 4 further goes downwards at a little higher speed until fully closed. At this time, the seat 4, if dropped at a little higher speed from 10 degrees, will not make a big sound because of little remaining amount of opening.

Said in another way, in the opening angle of 20 to 90 degrees, even if the compound torque is always slightly greater than the rotation moment of the seat and seat cover, the seat and seat cover are not automatically opened, because the opening and closing device has a friction functions based on the first rotation control means and the driving power transmitting means. That is, it is necessary to stop the seat and seat cover so that the compound torque is always slightly greater than the rotation moments of the seat and seat cover in the opening angle of 20 to 90 degrees.

The first rotation control means and the second rotation control means for controlling the rotation of the seat cover have not been explained. The seat and the seat cover are basically the same in construction with the exception of a difference in weight, unnecessity to stop and hold at an intermediate angle of opening, and furthermore a slight difference in the cam profile of the cam mechanism, an elastic force of the elastic means, and an elastic force of the torsion spring.

Figure 9:
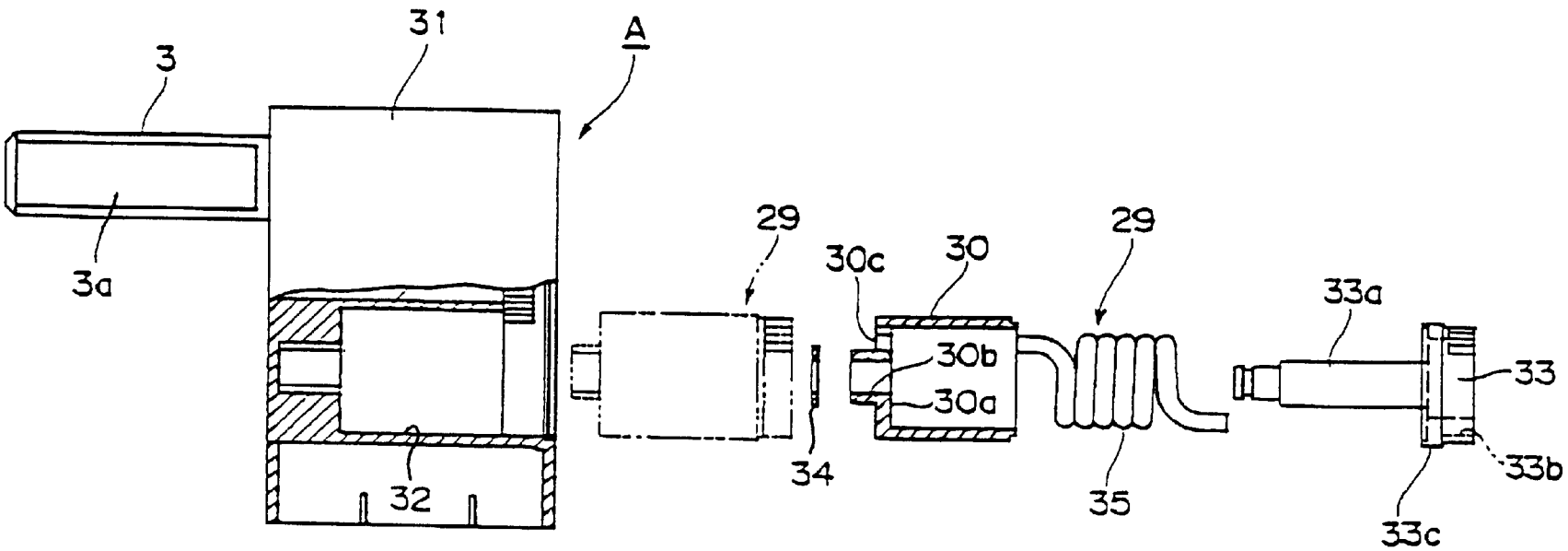
FIG. 9 is a front exploded view, partly in section, explaining other embodiment of a second torque control means of the present invention.

FIG. 9 shows another embodiment of a second control means 29.

In the above-described embodiment the support shaft 17 supporting the third gear 19 and wound with the torsion spring 21*a* protrudes into the case body. In the present embodiment, however, a spring case 30 is inserted and fixed so as not to rotate within a second housing section 32 of a case body 31. A support shaft 33*a* protruding from a third gear 33 in the axial direction in the case body 31 is rotatably engagedly supported on a bearing with an C-ring 34. A torsion spring 35 wound around the support shaft 33*a* and mounted within the spring case 30 is attached at one end in an engaging hole 30*c* provided in the spring case 30 and an engaging hole 33*b* provided in the third gear 33, and is elastically mounted between the spring case 30 and the third gear 33. The support shaft 33*a* is supported in a bearing hole 30*b* provided in one side wall 30*a* of the spring case 30 and the flange 33*c* provided on the outer periphery of the third gear 33 is supported firmly on a bearing in the inner peripheral wall of the case 30, thus being rotatably supported stably with respect to the case 30.

The present embodiment, therefore, has the advantage that the second rotation control means 29 can easily be installed to the case body 31.

What is claimed is:

1. An opening-closing device of a Western style toilet seat and seat cover, comprising:

a rotating shaft rotatably mounted in an axial direction of a case body adapted to be mounted on a toilet bowl;

a first rotation control means of said rotating shaft, having a cam mechanism, provided in a part housed in said case body;

second rotation control means of said rotating shaft, including a torsion spring, vertically juxtaposed in said case body above or below said first rotation control means;

a driving power transmitting means provided between said second rotation control means and said first rotation control means;

on said rotating shaft is rotatably mounted one of seat and seat cover mounting sections, and the other is fixedly attached on said rotating shaft so as to rotate together with said rotating shaft;

said cam mechanism being composed of a stationary cam provided in said case body, and a rotating-sliding cam which is mounted on said rotating shaft oppositely to said stationary cam, rotates together with said rotating shaft and axially slides, and an elastic means wound on said rotating shaft and sliding to press said rotating-sliding cam towards said stationary cam; and said torsion spring biasing said rotating shaft toward an opening direction of said seat and seat cover through said driving power transmitting means.

2. An opening-closing device of a Western style toilet seat and seat cover, comprising:

a rotating shaft rotatably mounted in an axial direction of a case body adapted to be mounted on a toilet bowl;

a first rotation control means of said rotating shaft, having a cam mechanism, provided in a part housed in said case body;

a second rotation control means of said rotating shaft, including a torsion spring, vertically juxtaposed in said case body above or below said first rotation control means;

a driving power transmitting means provided between said second rotation control means and said first rotation control means, said driving power transmitting means being composed of plural gears including one gear fixed to said rotating shaft, and an another gear rotatably mounted on a supporting shaft provided in said case body;

on said rotating shaft is rotatably mounted one of seat and seat cover mounting sections, and the other is fixedly attached on said rotating shaft so as to rotate together with said rotating shaft;

said first rotation control means being composed of a stationary cam provided in said case body, and a cam mechanism including a rotating-sliding cam which is mounted on said rotating shaft oppositely to said stationary cam, rotates together with said rotating shaft and axially slides, and an elastic means wound on said rotating shaft and sliding to press said rotating-sliding cam towards said stationary cam; and said torsion spring mounted around said supporting shaft, with one end thereof engaged with said case body, and with the other end thereof engaged with said another gear.

3. An opening-closing device of a Western style toilet seat and seat cover, comprising:

a rotating shaft rotatably mounted in an axial direction of a case body adapted to be mounted on a toilet bowl;

a first rotation control means of said rotating shaft, having a cam mechanism, provided in a part housed in said case body;

a second rotation control means of said rotating shaft, including a torsion spring, vertically juxtaposed in said case body above or below said first rotation control means;

a driving power transmitting means provided between said second rotation control means and said first rotation control means, said driving power transmitting means being composed of plural gears including one gear fixed to said rotating shaft, and another gear rotatably mounted on a supporting shaft provided in a spring case fixed so as not to rotate within said case body;

on said rotating shaft is rotatably mounted one of seat and seat cover mounting sections, and the other is fixedly attached on said rotating shaft so as to rotate together with said rotating;

said first rotation control means being composed of a stationary cam provided in said case body, and a cam mechanism including a rotating-sliding cam which is mounted on said rotating shaft oppositely to said stationary cam, rotates together with said rotating shaft and axially slides, and an elastic means wound on said rotating shaft and sliding to press said rotating-sliding cam towards said stationary cam; and said torsion spring mounted around said supporting shaft, with one end thereof engaged with said spring case, and with the other end thereof engaged with said another gear.

* * * * *